US005738534A

United States Patent [19]

Ingles et al.

[11] Patent Number: 5,738,534

[45] Date of Patent: Apr. 14, 1998

[54] MULTI-FUNCTION ELECTRICAL CONNECTOR

[76] Inventors: Gerald J. Ingles, R.R. #1, Granart Rd., Big Rock, Ill. 60511; Howard O. Wedell, 15336 Maple, Oak Forest, Ill. 60452; Michael Burman, 401 Pine St., New Lenox, Ill. 60451; Mario Garritano, 5324 West Kimball, Oak Lawn, Ill. 60453

[21] Appl. No.: 670,399

[22] Filed: Jun. 25, 1996

[51] Int. Cl.[6] ..... H01R 9/09

[52] U.S. Cl. ..... 439/83

[58] Field of Search ..... 439/83, 76.1, 58

[56] References Cited

U.S. PATENT DOCUMENTS

| | | | |
|---|---|---|---|
| 2,595,188 | 4/1952 | Del Camp | 439/58 OR |
| 3,457,541 | 7/1969 | Ransil et al. | 439/83 X |
| 3,662,230 | 5/1972 | Redwantz | 439/76.1 X |
| 4,785,988 | 11/1988 | Topel et al. | 228/122 |
| 5,143,273 | 9/1992 | Topel et al. | 228/56.3 |
| 5,260,549 | 11/1993 | Garritano | 219/541 |

*Primary Examiner*—Neil Abrams
*Assistant Examiner*—Daniel Wittels
*Attorney, Agent, or Firm*—David L. Newman, Esq.

[57] ABSTRACT

A multi-function electrical connector is provided having a plurality of contacts mounted at a base of an electrical connector, the contacts having a planar blade portion having solder pads thereon for surface mounting of the electrical connector to conductive traces of a substrate such as a glass material.

11 Claims, 1 Drawing Sheet

MULTI-FUNCTION ELECTRICAL CONNECTOR

BACKGROUND OF THE INVENTION

The present invention pertains to an electrical connector and, in particular, a multi-function electrical connector for connecting cables to a substrate.

The mounting of electrical cables to substrates has been accomplished by many means such as by connectors connected to the cable and mounting the connector to a substrate or by soldering the electrical cable directly to the substrate. In certain circumstances, such as the attachment of coaxial cables to the rear window of automobiles, in order to attach a telephone or radio to an antenna in the window, a cable lead was soldered directly to the glass. However, such assembly leaves a flying lead where the cable is attached to the glass at one end and is free at the other end. During installation of the glass into the automobile, the flying lead gets in the way and, in some cases, may be used as a handle by assembly line workers to pick up the glass. Such handling can cause damage to the connection of the cable to the glass. There is, therefore, desired a system which provides for a low-cost, low-profile connector for a substrate, such as glass and provides for a multi-function connector.

It is therefore and object of the present to provide for a low-cost, low-profile connector which enables for the quick and easy mounting of an electrical cable to a substrate to provide for an electrical connection.

It is a further object of the present invention to provide a connector which allows for the connection of a coaxial cable to a glass substrate quickly and inexpensively.

It is another object of the present invention to provide a connector which allows for the connection of multiple cables to a substrate with a single connector.

SUMMARY OF THE INVENTION

A principal object of this invention is to provide an electrical connector comprising a housing including contact receptacles mounted therein, electrical cables inserted within the housing attached to the contact receptacles and contacts having a planar blade portion mounted parallel to the base of the connector having a solder pad and a contact pin protruding perpendicular from the blade and inserted into the contact receptacle. The contact carrier may be mounted within an opening of the housing having a first side for attaching to the contact receptacles and a second side for attachment to the contacts. The connector housing may be molded of an insulating material and the connector receptacles may be insert molded within the housing. The housing may include an opening at its base for receiving a contact carrier which is frictionally fit within the opening. The electrical connector may have five contacts mounted to the electrical connector. The electrical connector may have a coaxial cable attached to the electrical connector. The contact blade may include a first end at which the contact pin is mounted and a second end having a solder pad mounted thereon and the first end being tapered from the second end wherein multiple contacts may be mounted to the electrical connector in adjacent positions so that the multiple contact pins form a circular pattern on the connector housing and the contact receptacles receiving the contact pins are also arranged in a circular pattern.

In an embodiment, an electrical connector is provided comprising a contact including a planar blade portion having a contact pin attached at a first end perpendicular to the blade portion and a solder pad mounted at a second end of the blade portion and the first end being tapered from the second end. The electrical connector may include the contact blade being mounted to the electrical connector so that it is flush and parallel to the base of the electrical connector. The electrical connector may include a base having multiple contacts mounted thereto having the contact pins inserted therein forming a circular pattern on the base. The electrical connector may include contact receptacles mounted therein arranged in a circular pattern corresponding to the contact pins.

In an embodiment, a method of assembling an electrical connector is provided comprising the steps of molding an electrical connector housing having an opening and insert molding contact receptacles within the housing, inserting a contact carrier within the opening, forming contacts having a planar blade portion and a contact pin perpendicular to the blade portion, inserting the contact pin of the contact within the contact carrier and into a corresponding contact receptacle and arranging the contact blade so that it lies flush and parallel to the base of the electrical connector. The electrical connector may be mounted to a substrate by placing the contact blades over a conductive trace on a substrate and the contact blades having solder pads and applying heat to the solder pads in order to reflow the solder to connect to the conductive traces of the substrate.

These and other features of the invention are set forth, below in the following detailed description of the presently preferred embodiments.

DETAILED DESCRIPTION OF THE PRESENTLY PREFERRED EMBODIMENTS

Figure 1:
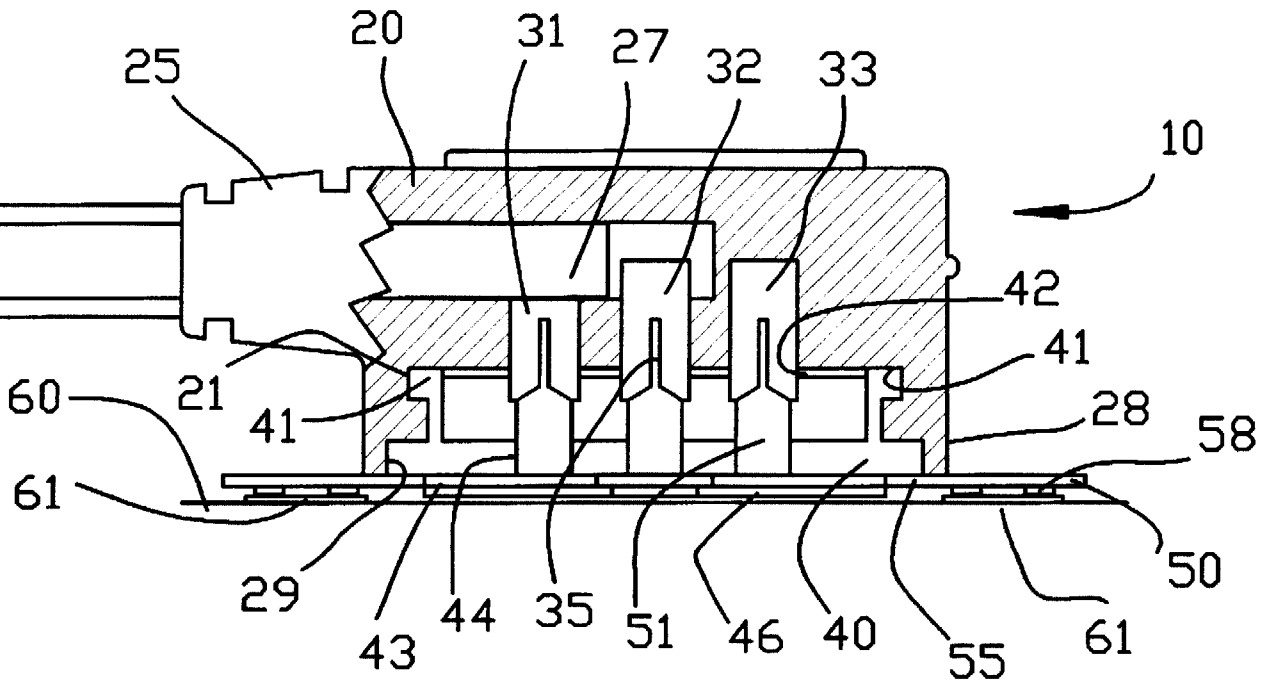
FIG. 1 is a side cut-away view of the connector of the present invention.
Figure 2:
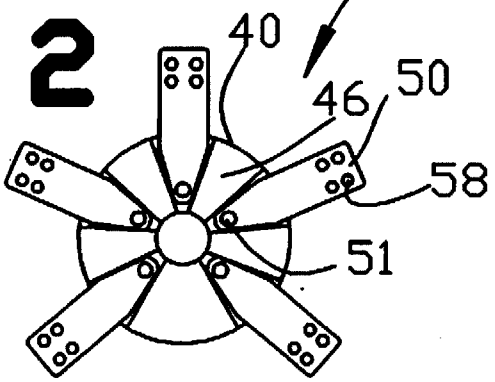
FIG. 2 is a plan view of the bottom of the connector of the present invention.
Figure 3:
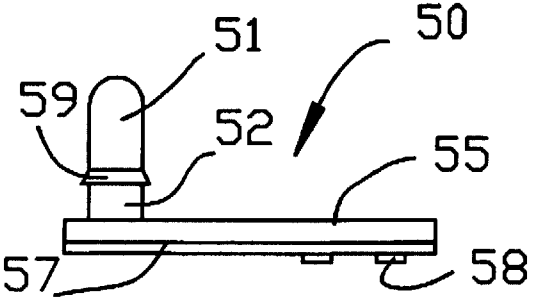
FIG. 3 is a side elevation view of the a contact of the connector of the present invention.

The invention is best understood with reference to FIGS. 1–3. FIG. 1 is a side elevation view partially cut-away of the electrical connector 10 of the present invention having a housing 20. In a preferred embodiment, the housing 20 is molded of a PVC material and integrally molded with the housing is a strain relief boot 25 for receiving electrical cables 26, 27. In a preferred embodiment, cable 26 is a coaxial cable and cable 27 is a discrete wire. The cables 26, 27 fan out within the housing 20 of the connector 10 and connect to individual contact receptacles 31, 32, 33. Each wire or conductor of the cables 26, 27 is mated to an individual contact receptacle 31, 32, 33. This view shows three contact receptacles 31, 32, 33, however, any number of wires and contact receptacles may be accommodated by the present invention.

In a preferred embodiment, the contact receptacles 31,32, 33 are insert molded within the housing 20. The housing includes at its base 28 an opening 29. Mounted in the opening 29 is a contact carrier 40. The contact carrier 40, in a preferred embodiment, is formed of a nonconductive material and includes at first side 41 holes 42 for receiving the contact receptacles 31, 32, 33 and at a second side 43, the contact carrier includes bores 44 for receiving contact posts 51 of contacts 50. The contact carrier 40 also includes a rim 41 which engages a recess 21 of the housing. In a preferred method of assembling the connector 10, after insert molding of the contact receptacles 31,32,33 within the housing 20, the contact carrier 40 is inserted within the opening 29. The contact carrier 40 is forced into the opening so that the rim 41 engages the recess 21 of the housing and the contact carrier 40 is frictionally held within the housing. The contact carrier is inserted within the housing and the holes 42 of the contact carrier surround the terminal ends of the contact receptacles 31,32,33 so that the contact receptacles protrude into the contact carrier 40. Contacts 50 are then mounted to the connector 10 by inserting contact posts 51 through the bores 44 in the second side of the contact carrier 40. The contact posts 51 are then inserted into the contact receptacles 31, 32, 33. The contact receptacles include a split area 35. The inner diameter of the contact receptacles 31, 32, 33 is generally equal to the outer diameter of the contact posts 51 so that upon insertion of the contact posts within the contact receptacle, a friction fit is achieved. The split 35 of the contact receptacle allows for the contact receptacle to expand slightly upon insertion of the contact posts 51.

Each contact 50 includes a contact blade 55 which upon insertion of the contact post 51 fully into the connector 10, the blade 55 will rest parallel and adjacent to the base 28 of the connector housing 10 and the edge of the blade 55 abuts against walls 46 of the contact carrier 40. This fully assembled connector may then be mounted to a substrate 60, for example, the rear window glass of an automobile. Conductive traces 61 are adhered to the split 35 of the contact receptacle allows for the contact receptacle to expand upon insertion of the contact posts 51. Each contact 50 includes a contact blade 55 which upon insertion of the contact post 51 fully into the connector 10, the blade 55 will rest adjacent and slightly substrate 60 in a predetermined location on the substrate 60. For example, a thermal set silver composition may be used. The conductive traces 61 carry electrical signals to components within the substrate 60. For example, the conductive traces may connect to an antenna embedded the window glass in order to provide reception or transmission for radios, cellular phones or global positioning systems. Such conductive traces 60 may also connect to defogging systems or other sensors in the substrate 60. Solder pads 58 are mounted on the terminal portions of the contact blade 50. The solder pad is mounted onto the conductive trace 61 of the, substrate 60. By application of heat, the solder pads 58 will reflow and adhere the contacts 50 to the conductive traces 61 of the substrate 60. This surface mount technique allows for the quick and easy attachment of the connector 10 to a substrate 60 and allows for the simultaneous connection of multiple cables for multiple functions using only the single connector 10.

Turning to FIG. 2, a bottom view of the connector 10 is shown having contacts 50 mounted on the contact carrier 40. The contact post 51 is inserted into the contact carrier 40 and the contact 50 is mounted between walls 46 at the base of the connector 10. Solder pads 58 allow for the surface mounting of the connector 10 to a substrate. The preferred embodiment shown in FIG. 2 shows five contacts 50. In such an embodiment, five separate electrical signals or current carrying lines may be accommodated by this multi-function connector 10. The present invention may also accommodate different numbers of contacts 50 in order to provide either more or less electrical connections.

FIG. 3 is a side elevation view of a contact 50 of the present invention having a contact post 51 and a blade 55. In a preferred embodiment, the blade is formed of copper having a thickness of approximately 0.030 inches and is covered by a solder layer 57, formed of tin, lead, silver and bismuth having a thickness of approximately 0.015 inches. The contact pin 51 is formed of a palladium nickel and is gold-plated. The contact pin 51 includes a lip 59 which protrudes beyond the overall diameter of the contact pin 51. The lip 59 acts to retain the contact 50 once it is inserted into the contact carrier 40. The lip 59 has a diameter greater than the bore 45 into which the contact pin 51 is inserted. After insertion of the lip 59 through the bore 44, the lip emerges at the other side of the bore 45 and the bore 45 contracts around the base portion 52 of the contact pin 51 in order to maintain the contact pin 51 within the bore 44 of the contact carrier 40 (see FIG. 1). Solder pads 58 are mounted onto the solder layer 57 of the contact blade 55. It can therefore be understood that the connector 10 of the present invention provides for the quick and easy attachment of multiple cables or wires to a substrate.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. An electrical connector comprising:

a housing including a base and contact receptacles mounted therein;

electrical cables inserted within the housing attached to the contact receptacles; and contacts having a planar blade portion mounted parallel to the base of the housing having a solder pad and a contact pin protruding perpendicular from the blade and inserted into the contact receptacle.

2. The electrical connector of claim 1 wherein a contact carrier is mounted within an opening of the housing having a first side for attaching to the contact receptacles and a second side for attaching to the contacts.

3. The electrical connector of claim 1 wherein the connector housing is molded of an insulating material and the connector receptacles are insert molded within the housing.

4. The electrical connector of claim 1 wherein the housing includes an opening at its base for receiving a contact carrier which is frictionally fit within the opening.

5. The electrical connector of claim 1 wherein five contacts are mounted to the electrical connector.

6. The electrical connector of claim 1 wherein a coaxial cable is attached to the electrical connector.

7. The electrical connector of claim 1 wherein the contact blade includes a first end at which the contact pin is mounted and a second end having a solder pad mounted thereon and the first end being tapered from the second end wherein multiple contacts may be mounted to the electrical connector in adjacent positions so that the multiple contact pins form a circular pattern on the connector housing and the contact receptacles receiving the contacts pins are also arranged in a circular pattern.

8. An electrical connector comprising:

a contact including a planar blade portion having a contact pin attached at a first end perpendicular to the blade portion and a solder pad mounted at a second end of the blade portion and the first end being tapered from the second end.

9. The electrical connector of claim 8 wherein the contact blade may be mounted to the electrical connector so that it is flush and parallel to a base of the electrical connector.

10. The electrical connector of claim 8 comprising; a base having multiple contacts mounted thereto having the contact pins inserted therein forming a circular pattern on the base.

11. The electrical connector of claim 10 having contact receptacles mounted therein arranged in a circular pattern corresponding to the contact pins.

* * * * *